US006449786B1

(12) United States Patent
Voit

(10) Patent No.: US 6,449,786 B1
(45) Date of Patent: Sep. 17, 2002

(54) CONNECTING DEVICE

(76) Inventor: Ronald J. Voit, 486 Fuller Pl., Lewiston, NY (US) 14092

( * ) Notice: Subject to any disclaimer, the term of this patent is extended or adjusted under 35 U.S.C. 154(b) by 0 days.

(21) Appl. No.: 10/031,528

(22) PCT Filed: Jun. 16, 2000

(86) PCT No.: PCT/US00/16616

§ 371 (c)(1),
(2), (4) Date: Jan. 16, 2002

(87) PCT Pub. No.: WO01/05277

PCT Pub. Date: Jan. 24, 2001

Related U.S. Application Data

(60) Provisional application No. 60/144,636, filed on Jul. 20, 1999.

(51) Int. Cl.[7] ..... A47C 19/00

(52) U.S. Cl. ..... 5/200.1; 5/201; 403/230; 403/281

(58) Field of Search ..... 5/200.1, 201, 282.1, 5/285, 286, 400; 403/230, 231, 281; 52/656.1, 656.8, 668, 690, 696

(56) References Cited

U.S. PATENT DOCUMENTS

| | | | |
|---|---|---|---|
| 2,774,609 | A | 12/1956 | Winger |
| 4,074,372 | A | 2/1978 | Schulz, Jr. |
| 4,391,008 | A | 7/1983 | Yamaoka et al. |
| 4,464,074 | A | 8/1984 | Green et al. |
| 4,613,999 | A | 9/1986 | Franco et al. |
| 4,617,689 | A | 10/1986 | Nelson et al. |
| 4,712,942 | A | 12/1987 | Brown |
| 4,788,727 | A | 12/1988 | Liu |
| 4,843,775 | A | 7/1989 | Armstrong et al. |
| 4,870,711 | A | 10/1989 | Felix |
| 5,099,529 | A | 3/1992 | Anderson |
| 5,144,706 | A | 9/1992 | Walker |
| 5,289,600 | A | 3/1994 | Schermel |
| 5,469,589 | A | 11/1995 | Steed et al. |
| 5,564,140 | A | 10/1996 | Shoenhair et al. |

*Primary Examiner*—Robert G. Santos
(74) *Attorney, Agent, or Firm*—Hodgson Russ LLP

(57) ABSTRACT

A connecting device having side support members with U-shaped slots disposed therein for connecting cross members. The cross members have ends cut at an angle such that the side support members are disposed at an angle of approximately sixty to eighty degrees with respect to a horizontal support surface.

15 Claims, 3 Drawing Sheets

CONNECTING DEVICE

CROSS-REFERENCE TO RELATED APPLICATION

Applicant hereby claims priority based on Provisional Application No. 60/144,636 filed Jul. 20, 1999, and entitled "BED FRAME" which is incorporated herein by reference.

FIELD OF THE INVENTION

The present invention generally pertains to connecting devices for connecting structural members and particularly to a bed frame construction.

BACKGROUND OF THE INVENTION

There is a need for a frame design, and in particular, a design for a connection between the side rails and cross-bearing members of a frame that is economical, easy to assemble, and safer than conventional designs.

SUMMARY OF THE INVENTION

The present invention meets the above-described need by providing a connecting device with a structural member having opposed end walls connected to a side wall. Each of the end walls has an inner wall extending therefrom in spaced apart relation to the side wall. The structural member has a first slot and a second slot. The first slot extends from the end wall through the inner wall and the second slot extends through the opposite inner wall.

A cross-bearing member having a side wall, end wall, inner wall and top wall disposed on at least one end engages with the structural member. The end wall and inner wall connect to the side wall and are spaced apart from the top wall such that the end wall, inner wall and side wall are capable of sliding through the first slot in the structural member and the side wall on the opposite end is capable of sliding through the second slot.

BRIEF DESCRIPTION OF THE DRAWINGS

The invention is illustrated in the drawings in which like reference characters designate the same or similar parts throughout the figures of which.

DESCRIPTION OF THE PREFERRED EMBODIMENTS

Figure 1:
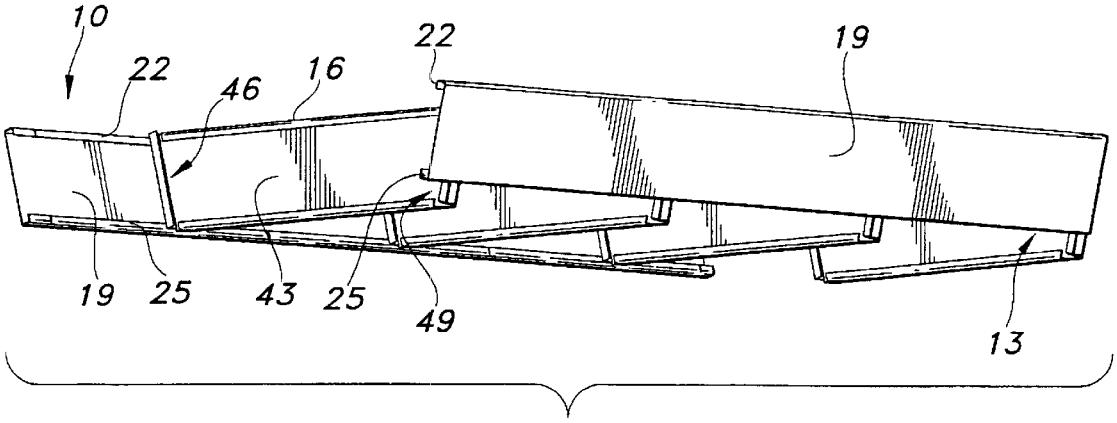
FIG. 1 is a perspective view of the connecting device of the present invention.
Figure 4:
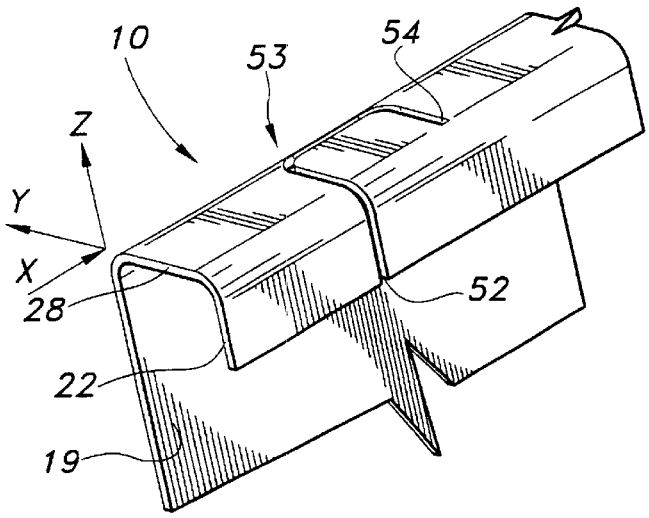
FIG. 4 is an enlarged perspective view of the inside top of one of the side support members.

In FIG. 1, a pair of structural members 10, 13 are connected by a plurality of cross-bearing members 16. The structural members 10, 13 comprise a left hand member 10 and a right hand member 13. The members 10, 13 are substantially similar except for their right and left hand orientation as described herein. The members 10, 13 are defined along a longitudinal axis X and axes Y, Z as shown in FIG. 4. The members 10, 13 are preferably constructed from metal (18 gauge steel), although wood or plastic would also be suitable in some instances. The members 10, 13 have a substantially planar side wall 19 that extends along the entire length of the member. At the top and bottom of the side wall 19 there are inner walls 22, 25 respectively. The inner walls 22, 25 are preferably integrally formed by bending the metal. The top inner wall 22 extends substantially parallel to the side wall 19. An end wall 28 (shown in FIG. 4) extends substantially perpendicular to the side wall 19.

The bottom inner wall 25 extends parallel to side wall 19, and the bottom end wall 31 (shown in FIG. 5) extends substantially perpendicular to side wall 19. The cross-bearing members 16 connect to the side structural members 10, 13 at opposite ends as detailed herein. The cross-bearing members 16 have a central portion 43 disposed between opposite ends 46, 49. The ends 46, 49 interlock with a plurality of slots 52, 55 (shown in FIGS. 4–5) in the side support members 10, 13 as detailed below.

Figure 2:
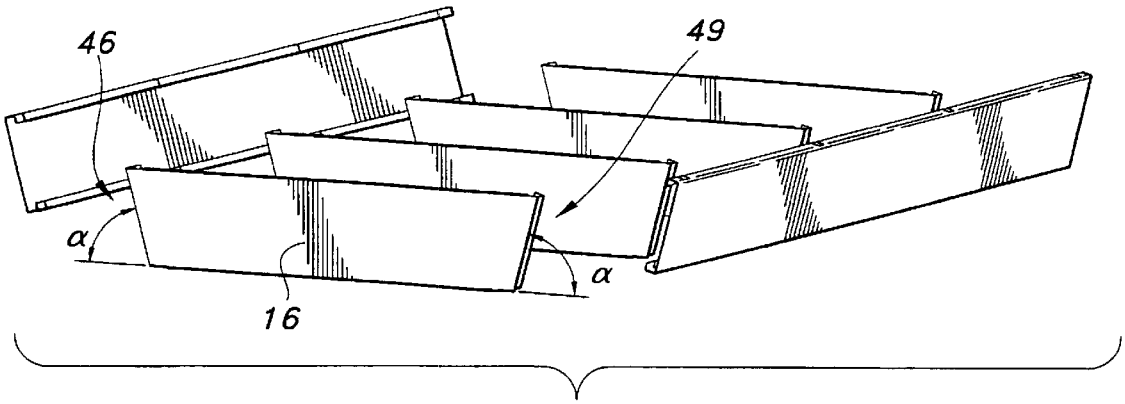
FIG. 2 is an exploded view of the connecting device of the present invention.
Figure 3:
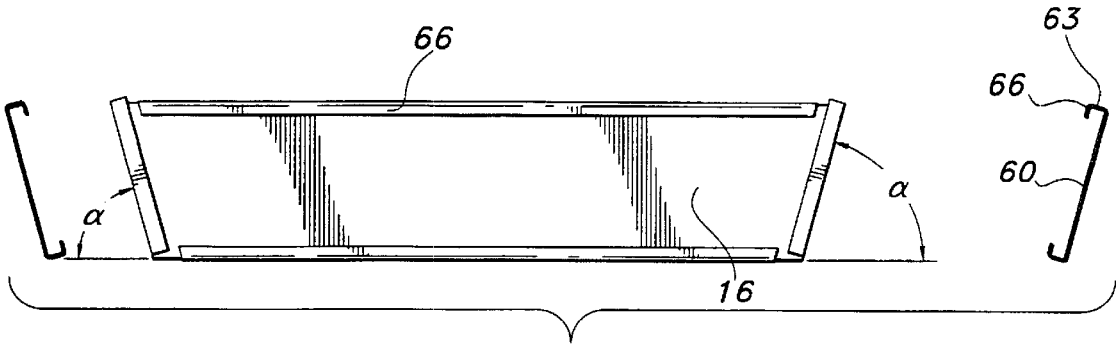
FIG. 3 is a front elevation view of the cross member of the present invention.

Turning to FIGS. 2 and 3, the cross-bearing members 16 are angled at the ends 46, 49 at an angle a of approximately sixty to eighty degrees with the horizontal. As a result when the side support members 10, 13 are connected by the cross members 16, they also take an angle of approximately sixty to eighty degrees to the horizontal.

In FIG. 4, the structural member 10 is shown in greater detail. As shown the ends of the side support member 10 include an end wall 28 perpendicular to the side wall 19 and an inner wall 22 parallel to the side wall 19. A slot 52 terminates at one end at the end of the inner wall 22. The slot 52 extends along the Z-axis to end wall 28. Then the slot 52 extends along the Y-axis to a point 53 near the side wall 19 (best shown in FIG. 8). The slot 52 then extends in a straight line along the X-axis for approximately one inch. Next, the slot 52 turns inward and extends along the Y-axis to a termination point 54 on the end wall 28. Accordingly, the slot 52 forms a U-shape inside the end wall 28 and then extends through the edge of the inner wall 22. The slot 52 must generally permit the side wall 60 (shown in FIG. 6) to pass through and must engage with a portion of the end of the cross-bearing member 16 to hold it in position. Accordingly, other shapes for slot 52 and end wall 28 and inner wall 22 capable of accomplishing the above are also suitable. The slot 52 receives the end 46 (shown in FIG. 6) of the cross-bearing member 16 in sliding fashion as described hereafter.

Figure 5:
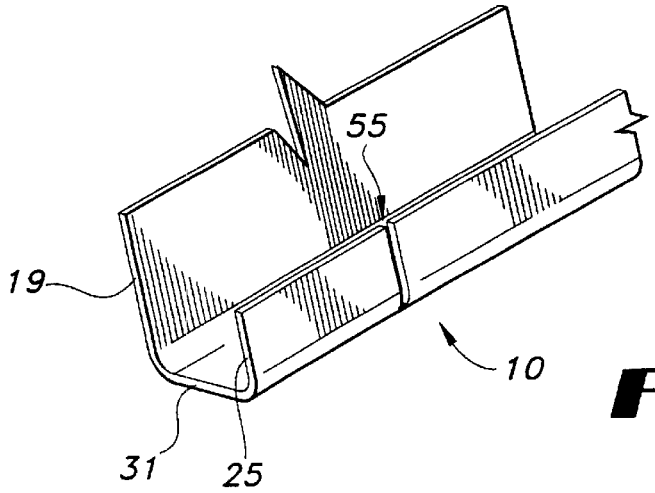
FIG. 5 is an enlarged perspective view of the inside bottom of one of the side support members.

Turning to FIG. 5, the inside bottom portion of the side support member 10 has a corresponding slot 55 that also receives the end 46 of cross-bearing member 16.

Figure 6:
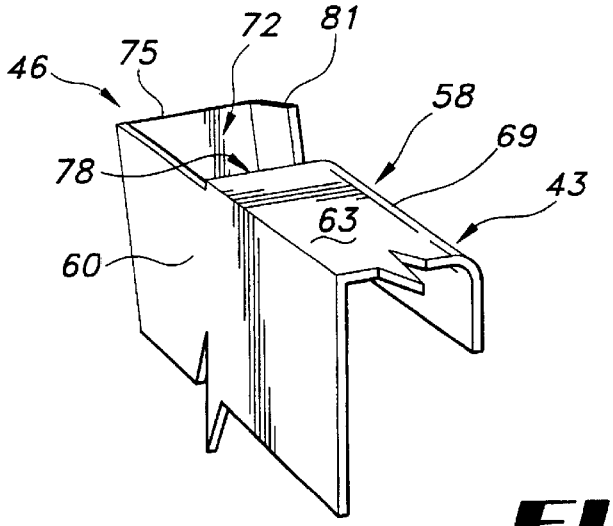
FIG. 6 is an enlarged perspective view of the top of one of the cross members.

In FIG. 6, the end 46 and central portion 43 of cross-bearing member 16 is shown in detail. The central portion 43 of cross-bearing member 16 has a vertical side wall 60, a top wall 63 disposed perpendicular to the side wall 60, and a third wall 66 (shown in FIG. 3) connected to the top wall 63 by a curved section 69. The third wall 66 extends parallel to but is much shorter than the vertical side wall 60. The end 46 has an opening 72 defined by an end wall 75 disposed perpendicular to the vertical side wall 60. The opening 72 of approximately five-eighths of an inch is positioned between the end 78 of the top wall 63 and the end wall 75. The end wall 75 has an inner wall 81 disposed perpendicular to it and disposed in spaced apart parallel relation to the vertical side wall 60. The end wall 75 is approximately three-quarters of an inch wide, and the inner wall 81 is approximately one-half inch wide. Accordingly, end 46 is capable of sliding downward through slot 52 from the top of the side support member 10 to the bottom of side support member 10 (shown in FIGS. 4 and 5).

As shown in FIG. 4, the end wall 28 of the structural member 10 has an opening defined by slot 52 that is capable of receiving the side wall 60, the end wall 75, and the inner wall 81. Turning to FIG. 5, the bottom of the side support member 10 only has a slot 55 for the side wall 60 to pass through. An opening for the end wall 75 and the inner wall 81 is not necessary at the bottom because these walls fit inside the space between the side wall 19 and the inner wall 25.

Figure 7:
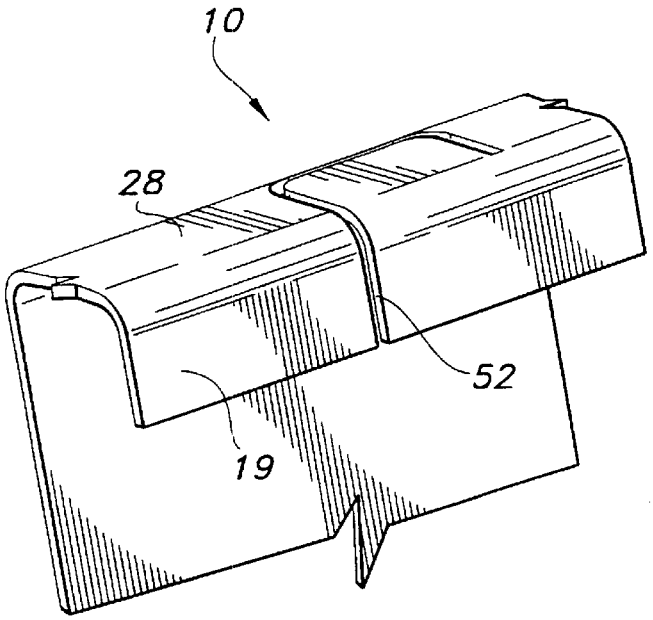
FIG. 7 is a perspective view of the front top of one of the side support members; and, FIG. 8 is a perspective rear view of the top of one of the side support members.
Figure 8:
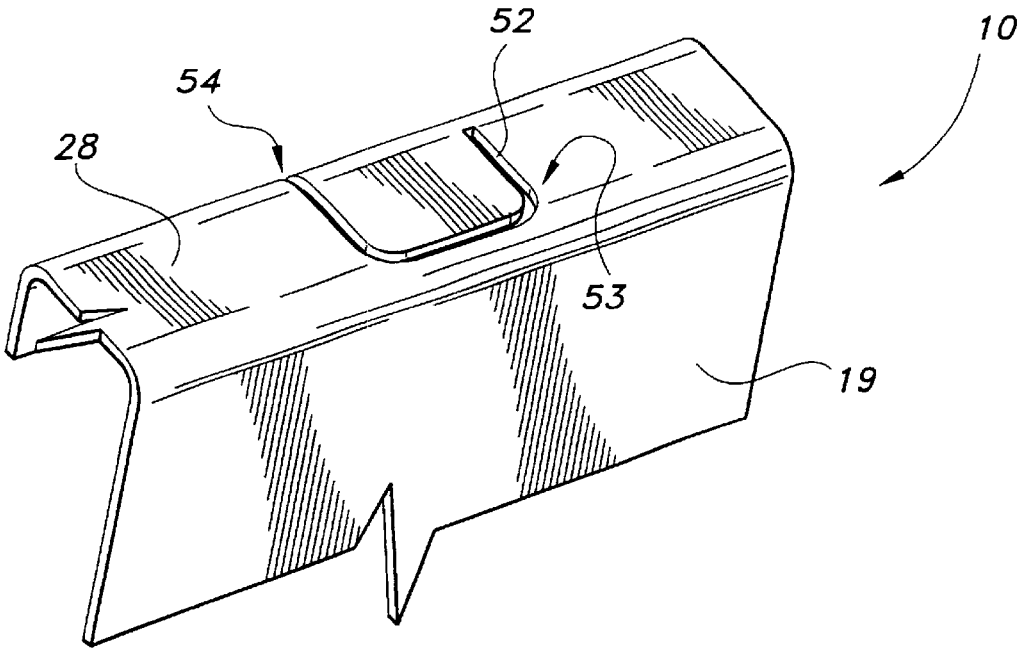

FIG. 7 shows slot 52 from the inside of structural member 10, and FIG. 8 shows slot 52 from the back of structural member 10.

Structural member 13 is substantially similar to member 10 and has slot 52 disposed at the top such that it faces slot 52 on member 10 when the side support members are disposed as shown in FIGS. 1 and 2.

End 49 is substantially similar to end 46 described above. Accordingly, ends 46, 49 engage with structural members 10, 13 in a similar fashion as described above.

The present invention provides a connecting device that is secure, easy to assembly and disassemble, and of relatively simple construction. When the connecting device is used with side rails and cross-bearing members to form a bed frame, the sixty to eighty degree angle on the end of the cross-bearing member provides for clearance around the perimeter of the bed at the floor level.

The present invention advantageously provides a connecting device for structural beams that can be used in many applications besides the bed frame disclosed herein. The connection device can be used for connecting floor joists, rafters, bridges, shelving, and the like.

While the invention has been described in connection with certain preferred embodiments, it is not intended to limit the scope of the invention to the particular forms set forth, but, on the contrary, it is intended to cover such alternatives, modifications, and equivalents as may be included within the spirit and scope of the invention as defined by the appended claims.

What is claimed is:

1. A connecting device, comprising:

a structural member having a pair of opposed first and second end walls connected by a first side wall and having a pair of opposed first and second inner walls extending from the first and second end walls respectively and disposed in spaced apart relation to the first side wall, the first end wall having a first slot defined therein and extending from the first end wall through the adjacent first inner wall, the second inner wall having a second slot defined therein; and, a cross-bearing member having a third end wall connected to a second side wall and connected to a third inner wall disposed in spaced apart relation to the second side wall, the third end wall being disposed such that the second side wall, third inner wall, and third end wall are capable of sliding through the first slot in the first end wall of the structural member and such that the second side wall is capable of passing through the second slot in the second inner wall of the structural member.

2. The connecting device of claim 1, wherein the third end wall of the cross-bearing member is angled at approximately sixty to eighty degrees with respect to a horizontal support surface.

3. The connecting device of claim 1, wherein the first and second inner walls on the structural member are disposed substantially parallel to the first side wall.

4. The connecting device of claim 1, wherein the third inner wall on the cross-bearing member is disposed substantially parallel to the second side wall.

5. The connecting device of claim 1, wherein the first slot on the structural member has a U-shaped portion disposed in the first end wall.

6. The connecting device of claim 1, wherein the cross-bearing member has a top wall that is substantially perpendicular to the second side wall.

7. The connecting device of claim 1, wherein the third end wall is substantially perpendicular to the second side wall.

8. The connecting device of claim 1, wherein the first and second inner walls are shorter than the first side wall such that an opening is formed in the structural member.

9. A connecting device, comprising:

at least two structural members having a pair of opposed first and second end walls connected by a first side wall and having a pair of opposed first and second inner walls extending from the first and second end walls respectively and disposed in spaced apart relation to the first side wall, the first and second end walls disposed substantially perpendicular to the first side wall, the first and second inner walls disposed substantially parallel to the first side wall, the first and second inner walls being shorter than the first side wall such that an opening is formed in the structural member, the first end wall having at least one first slot defined therein and extending from the first end wall through the adjacent first inner wall, the second inner wall having at least one second slot defined therein; and, a cross-bearing member having a third end wall and a fourth end wall connected by a second side wall and a third inner wall and a fourth inner wall disposed in spaced apart relation to the second side wall, the third end wall and fourth end wall being disposed such that the second side wall, third inner wall, and third end wall are capable of sliding through one of the first slots in the first end wall of the structural member and such that the second side wall is capable of passing through one of the second slots in the second inner wall of the structural member and such that the second side wall, fourth inner wall and fourth end wall are capable of sliding through one of the first slots in the first end wall of the structural member and such that the second side wall is capable of passing through one of the second slots in the second inner wall of the structural member.

10. The connecting device of claim 9, wherein the third end wall and fourth end wall of the cross-bearing member are angled at approximately sixty to eighty degrees with respect to a horizontal support surface.

11. The connecting device of claim 9, wherein the at least one first slot on the structural member has a U-shaped portion disposed in the first end wall.

12. The connecting device of claim 9, wherein the cross-bearing member has a top wall that is substantially perpendicular to the second side wall.

13. The connecting device of claim 9, wherein the third end wall is substantially perpendicular to the second side wall.

14. The connecting device of claim 9, wherein the first and second inner walls are shorter than the first side wall such that an opening is formed in the structural member.

15. A bed frame, comprising:

at least two structural members having a pair of opposed first and second end walls connected by a first side wall and having a pair of opposed first and second inner walls extending from the first and second end walls respectively and disposed in spaced apart relation to the first side wall, the first and second end walls disposed substantially perpendicular to the first side wall, the first and second inner walls disposed substantially parallel to the first side wall, the first and second inner walls being shorter than the first side wall such that an opening is formed in the structural member, the first end wall having at least one first slot defined therein and extending from the first end wall through the adjacent first inner wall, the second inner wall having at least one second slot defined therein; and, at least one cross-bearing member having a third end wall and a fourth end wall connected by a second side wall and a third inner wall and a fourth inner wall disposed in spaced apart relation to the second side wall, the third end wall and fourth end wall being disposed such that the second side wall, third inner wall, and third end wall are capable of sliding through one of the first slots in the first end wall of the structural member and such that the second side wall is capable of passing through one of the second slots in the second inner wall of the structural member and such that the second side wall, fourth inner wall and fourth end wall are capable of sliding through one of the first slots in the first end wall of the structural member and such that the second side wall is capable of passing through one of the second slots in the second inner wall of the structural member, the third and fourth end walls being disposed at an angle of sixty to eighty degrees with respect to the top wall.

* * * * *